US005272505A

United States Patent [19]

Shishido et al.

[11] Patent Number: 5,272,505

[45] Date of Patent: Dec. 21, 1993

[54] CHARGING DEVICE, PROCESS UNIT HAVING SAME AND IMAGE FORMING APPARATUS USING PROCESS UNIT

[75] Inventors: Kazuo Shishido; Yasushi Sato, both of Kawasaki; Shinichi Sasaki, Fujisawa; Hiroaki Miyake, Yokohama; Yoshiya Nomura, Tokyo, all of Japan

[73] Assignee: Canon Kabushiki Kaisha, Tokyo, Japan

[21] Appl. No.: 780,474

[22] Filed: Oct. 22, 1991

[30] Foreign Application Priority Data

Oct. 24, 1990 [JP] Japan ..... 2-287558

[51] Int. Cl.[5] ..... G03G 15/02

[52] U.S. Cl. ..... 355/219; 361/221; 355/210

[58] Field of Search ..... 355/202, 219, 210; 361/220, 221, 212, 214, 225; 250/324, 325, 326

[56] References Cited

U.S. PATENT DOCUMENTS 4,387,780 6/1983 Ueno et al. ..... 355/219
4,646,196 2/1987 Reale ..... 250/324 X
4,761,709 8/1988 Ewing et al. ..... 361/225

FOREIGN PATENT DOCUMENTS 267667 10/1989 Japan ..... 355/219

*Primary Examiner*—R. L. Moses
*Assistant Examiner*—J. E. Barlow, Jr.
*Attorney, Agent, or Firm*—Fitzpatrick, Cella, Harper & Scinto

[57] ABSTRACT

A charging apparatus includes a charging member contactable to a member to be charged to charge the member to be charged; a power source for supplying a voltage between the charging member and the member to be charged; and a conductive member for covering a contact portion between the charging member and the member to be charged, the conductive member being electrically grounded.

23 Claims, 6 Drawing Sheets

CHARGING DEVICE, PROCESS UNIT HAVING SAME AND IMAGE FORMING APPARATUS USING PROCESS UNIT

FIELD OF THE INVENTION AND RELATED ART

The present invention relates to a charging device having a charging member contactable to a member to be charged usable with an electrophotographic machine or the like, a process unit having the charging device, and an image forming apparatus usable with the process unit.

A corona discharger is known as a charging device usable with an image forming apparatus such as an electrophotographic copying machine. It includes a wire electrode faced to a photosensitive and member, a shield electrode enclosing the wire electrode.

However, the corona discharger has drawbacks. For example, the voltage to be applied to the wire electrode is as high as 4–8 KV. the charging efficiency is low because most of the electric current flows from the wire electrode to the shield electrode. A relatively large amount of ozone is produced by the corona discharging. The discharging becomes uniform because of the contamination of the wire electrode.

In order to avoid these problems, a charging means having a charging member contactable to a member to be charged has been proposed as described in patents assigned to the assignee of this application.

FIG. 5 shows an example of an electrophotographic apparatus using the contact type charging device. The photosensitive member 1 rotates in the direction indicated by an arrow, and the charging roller 2 is urged by a spring 3 to the photosensitive member 1 to form a nip n therewith. By the application of the bias voltage to the roller 2 from the voltage source 19, the photosensitive member 1 is charged. Thereafter, the photosensitive member 1 is exposed to image light 4 so that an electrostatic latent image is formed. The electrostatic latent image on the photosensitive member 1 is developed by a developing device 15 into a toner image. The toner image is transferred onto a transfer sheet 16 by transfer means 17. The transfer sheet 16 is fixed by an unshown image fixing device by heat into a permanent image. The residual toner remaining on the photosensitive member 1 after the image transfer operation, is removed by the cleaner 18, so that the photosensitive member 1 is prepared for the next image forming operation.

In the conventional example shown in FIG. 5, a problem of electrostatic noise produced by the charging action and emitted to the outside of the apparatus has been found. More particularly, referring to FIG. 5, when the charging action occurs in the neighborhood of the nip n, the electrostatic noise is emitted from the neighborhood to the side away from the photosensitive member 1 (upward in the Figure).

The electronic wave trouble due to the emitted (electrostatic) noise may cause erroneous operation of electronic devices. Therefore, it is desired to reduce the noise emitted to the outside of the apparatus.

In the conventional example shown in FIG. 5, the emitted noise is as high as 45 Db (micro-volt/m).

SUMMARY OF THE INVENTION

Accordingly, it is a principal object of the present invention to provide a charging device, a process unit having the charging device and an image forming apparatus usable with a process unit in which the electrostatic noise emitted from the charging member is reduced.

It is another object of the present invention to provide a charging device, a process unit having the charging device and an image forming apparatus usable with a process unit wherein the charging efficiency is high with low cost.

It is a further object of the present invention to provide a charging device, a process unit having the charging device and an image forming apparatus usable with the process unit wherein the production of ozone is low.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
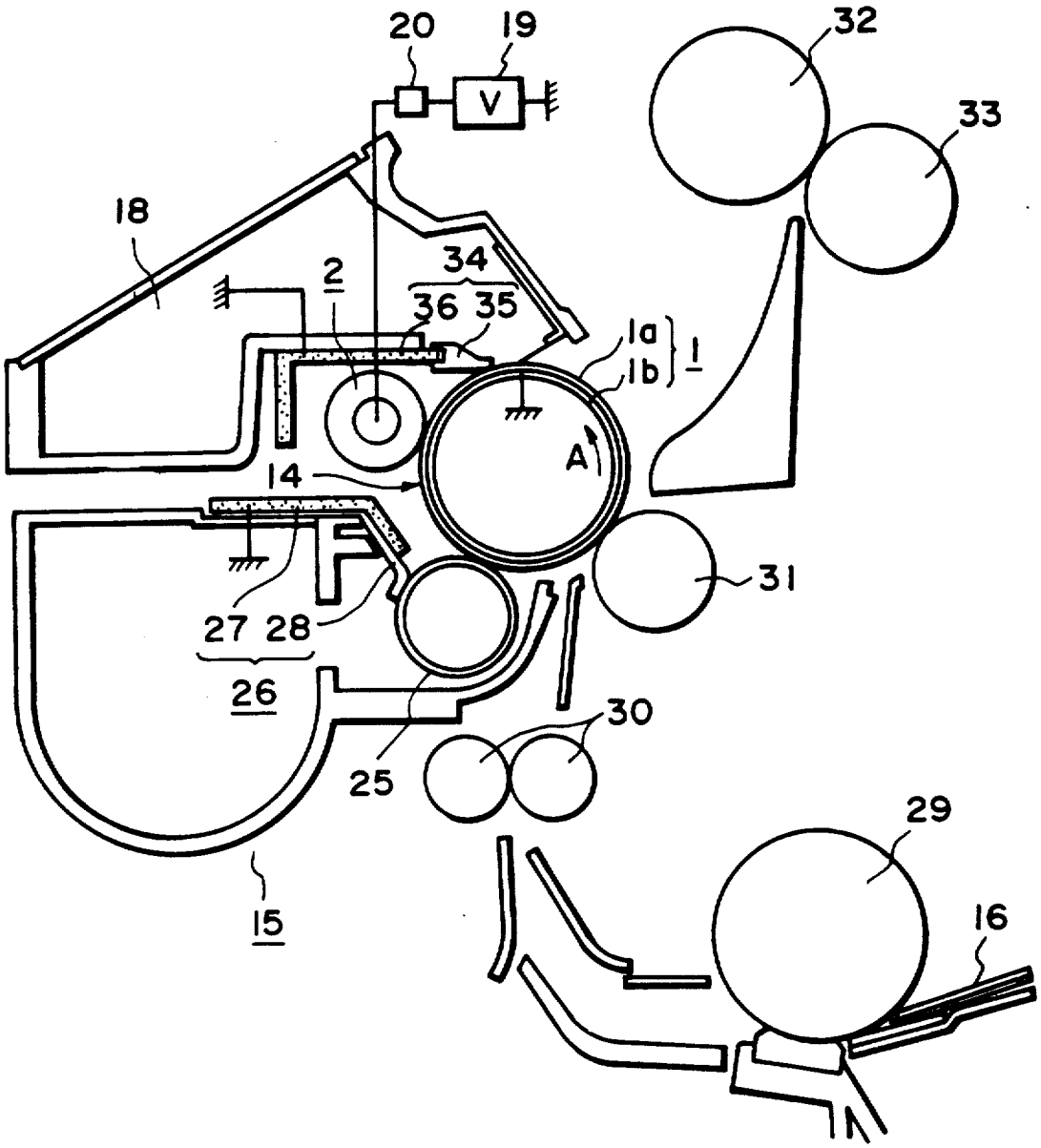
FIG. 1 is a side view of an image forming apparatus according to a first embodiment of the present invention.

Referring to FIG. 1, there is shown an image forming apparatus comprising an image bearing member (a member to be charged) in the form of a photosensitive member 1. It comprises a conductive base **1*b* made of aluminum, iron or the like and a photosensitive layer 1*a*. The conductive base 1*b* is grounded. The charging member in the form of a charging roller 2 is in contact with the surface of the photosensitive member 1 and is connected with a power source 19 for supplying a voltage between the charging roller 2 and the photosensitive member 1**.

When the photosensitive member 1 rotates in a direction A, the photosensitive member 1 is charged (primary charge) by the charging roller 2 which is driven by the photosensitive member 1. A laser beam 14 from a laser scanning device not shown is projected on the photosensitive member 1 by which an electrostatic latent image is formed thereon. The latent image is developed by a developing device 15 with the toner powder carried on a developing sleeve 25 in the form of a toner layer. The thickness of the toner layer is regulated by a developing blade 26. A transfer sheet 16 is supplied by a sheet feeding roller 29 and is further fed to the photosensitive member with a timed relation therewith by a pair of registration rollers 30. The toner image on the photosensitive member 1 is transferred onto the transfer material or sheet 16 by the transfer roller 31. The transfer material 16 on which the toner image has been transferred is fixed on an image fixing device having an image fixing roller 32 and a pressing roller 33. The toner remaining on the photosensitive member 1 after the transfer operation, is removed from the photosensitive member 1 by the cleaning device 18.

The voltage source 19 supplies to the core metal of the charging roller 2 an oscillating voltage having a DC component (700 V) and an oscillating component (500 V of peak-to-peak voltage) having a periodically changing voltage level. The peak-to-peak voltage is not less than twice a charge starting voltage between the photosensitive member 1 and the charging roller, as disclosed in U.S. Pat. No. 4,851,960. By doing so, the potential of the charged photosensitive member 1 becomes uniform. The waveform of the oscillating component may be a sine wave, a rectangular wave, a triangular wave or the like. The oscillating voltage may be provided by switching on and off a DC voltage source. An oscillating component supplied to the charging roller 2 is controlled so as to be constant (560 micro-ampere) by controlling means 20. By the constant current control of the oscillating component, a constant alternating electric field is formed between the photosensitive drum 1 and the charging roller 2 even if an ambient condition such as the temperature or the humidity changes. Therefore, the photosensitive drum 1 can be uniformly charged at all times irrespective of the ambient condition. In order to provide uniform charging regardless of the ambient condition, it is preferable that the constant current control is effected so that the peak-to-peak voltage of the oscillating component of the voltage is always not less than twice the charge starting voltage between the photosensitive drum 1 and the charging roller 2. The current level at this time was 560 micro-ampere.

In this embodiment, the cleaning device 18 has a cleaning blade 34 which comprises a rubber chip 35 having an elastic side edge and a holder 36 made of conductive material and for supporting the rubber chip 35. The holder 36 is in an L-shape covering the charging roller 2. The holder 36 is made of metal such as iron and is grounded. It covers the nip between the photosensitive member 1 and the charging roller 2, and substantially sandwiches the charging roller 2 in cooperation with the photosensitive member 1.

Because of this arrangement, the electrostatic noise produced in the neighborhood of the nip between the photosensitive member 1 and the charging roller 2 is prevented from emitting toward the cleaner 18. Since the holder 36 of the cleaning blade 34 is in the shape of an L, the rigidity of the holder 36 itself is improved.

The developing blade 26 of the developing device 15 comprises a rubber blade 28 made of urethane or the like and is effective to regulate a thickness of a toner layer on the developing sleeve 25 made of aluminum or the like, a blade holder 27 for supporting the rubber blade 28. The blade holder 27 is made of metal such as iron or the like and is grounded. The blade holder 27 is electrically conductive. The holder 27 covers the nip between the photosensitive member 1 and the charging roller 2. Therefore, the blade holder 27 is effective to prevent the electrostatic noise produced in the neighborhood of the nip from emitting to the developing device 15.

The emission of electrostatic noise from the nip to the photosensitive drum 1 is prevented because the base member of the photosensitive drum 1 i made of electrically conductive material such as aluminum.

In this embodiment, in order to assure the reduction of noise radiation, the cleaning blade holder 36 and the developing blade holder 27 are grounded. The holders 36 and 27 have lengths which are larger than the roller 2 in the direction of the generating line of the charging roller (in the direction perpendicular to the sheet of the drawing of FIG. 1). In this embodiment, the electromagnetic field strength which represents the strength of the emitted noise was less than 30 Db.

Since the cleaning blade holder 36 and the developing blade holder 27 constitute conductive members covering the charging roller 2 in this embodiment, there is no need for using an additional shielding member, and therefore, the shielding effect can be provided at low cost, and no additional space is required for the shielding member or members.

Figure 2:
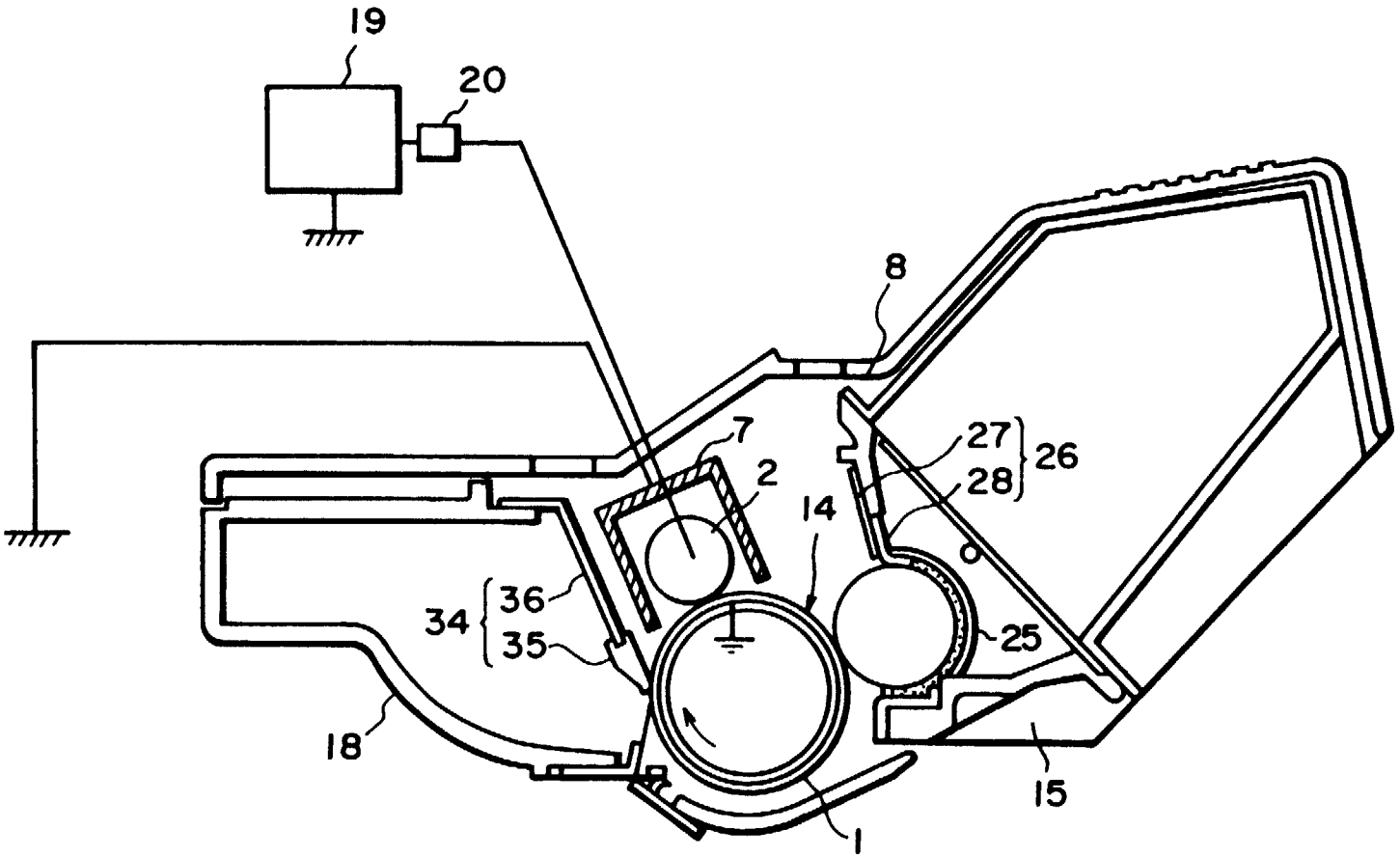
FIG. 2 is a side view of a process unit according to a second embodiment of the present invention.

FIG. 2 illustrates a device according to another embodiment of the present invention which is a process unit detachably mountable to an image forming apparatus. The process unit is mounted in a main assembly of an image forming apparatus. When an image formation signal is produced, a photosensitive member 1 rotates in a direction indicated by an arrow, and is charged (primary charge) by a charging roller 2 which is connected to a voltage source 19 in the main assembly through a constant current control means 20. By a laser beam exposure 14 using a laser scanner, an electrostatic latent image is formed on the photosensitive member 1. The electrostatic latent image is developed by the developing device 15 with the toner powder on a developing sleeve 25. The toner is in the form of a layer thereof on the developing sleeve 25, and the thickness of the layer is regulated by the developing blade 26. The electrostatic latent image is thus developed into a visualized image. A transfer material is fed by an unshown feeding roller and is conveyed in timed relation with the toner image on the photosensitive member 1 by a pair of registration rollers (not shown). The visualized image is transferred onto the transfer sheet by an unshown image transfer roller. The transfer material now having the toner image is conveyed to an image fixing device where the image is fixed by an unshown image fixing roller and pressing roller. The toner remaining on the photosensitive member 1 after the image transfer operation is removed by a cleaner 18.

The charging roller 2 in contact with the photosensitive member 1 is supported on a holder 7 for supporting an insulative bearing for a core shaft of the charging roller 2. The holder 7 is made of electrically conductive metal such as iron. The holder 7 is grounded to the main assembly of the image forming apparatus. The holder 7 is longer than the charging roller 2 in the direction of the generating line of the charging roller (the direction perpendicular to the sheet of the drawing of FIG. 2) so that it covers the roller 2 at the opposite longitudinal ends of the roller 2. In other words, adjacent the opposite ends of the roller 2, holder walls are provided also in the direction transverse to the generating line direction (parallel to the sheet of the drawing). Therefore, the noise emitted from the neighborhood of the nip between the photosensitive member 1 and the charging roller 2 can be stopped by the grounded charging holder 7 and photosensitive member 1.

The electromagnetic field density in this embodiment was less than 30 Db, which is significantly lower than 45 Db which was measured for a non-conductive resin material holder.

Figure 6:
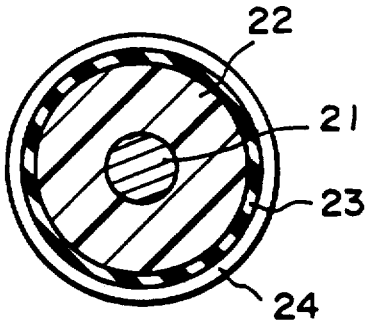
FIG. 6 is a sectional view of an example of a contact type charging roller.

FIG. 6 shows a preferable example of the charging roller 2 in the foregoing embodiment. It comprises a metal core 21, an electrically conductive elastic layer 22 thereon, a high resistance elastic layer 23 thereon and a surface protection layer 24. The electrically conductive elastic layer 22 is of EPDM (ethylenepropyenediene tercopolymer) in which carbon is dispersed and functions to supply the bias voltage from the core metal 21. The high resistance elastic layer 23 is of urethane rubber or the like and may contain a small amount of conductive fine particles (carbon, for example). The high resistance elastic layer 23 functions to limit the leak current to the photosensitive member 1, thus preventing the voltage drop even if the charging roller 2 is contacted to a highly conductive part of the photosensitive member 1 (pinhole, for example). The surface protection layer 24 is of N-methylmethoxynylon and is effective to protect the surface of the photosensitive member 1 from being deteriorated by the material of the conductive elastic layer 23 or the high resistance elastic layer 23.

Figure 3:
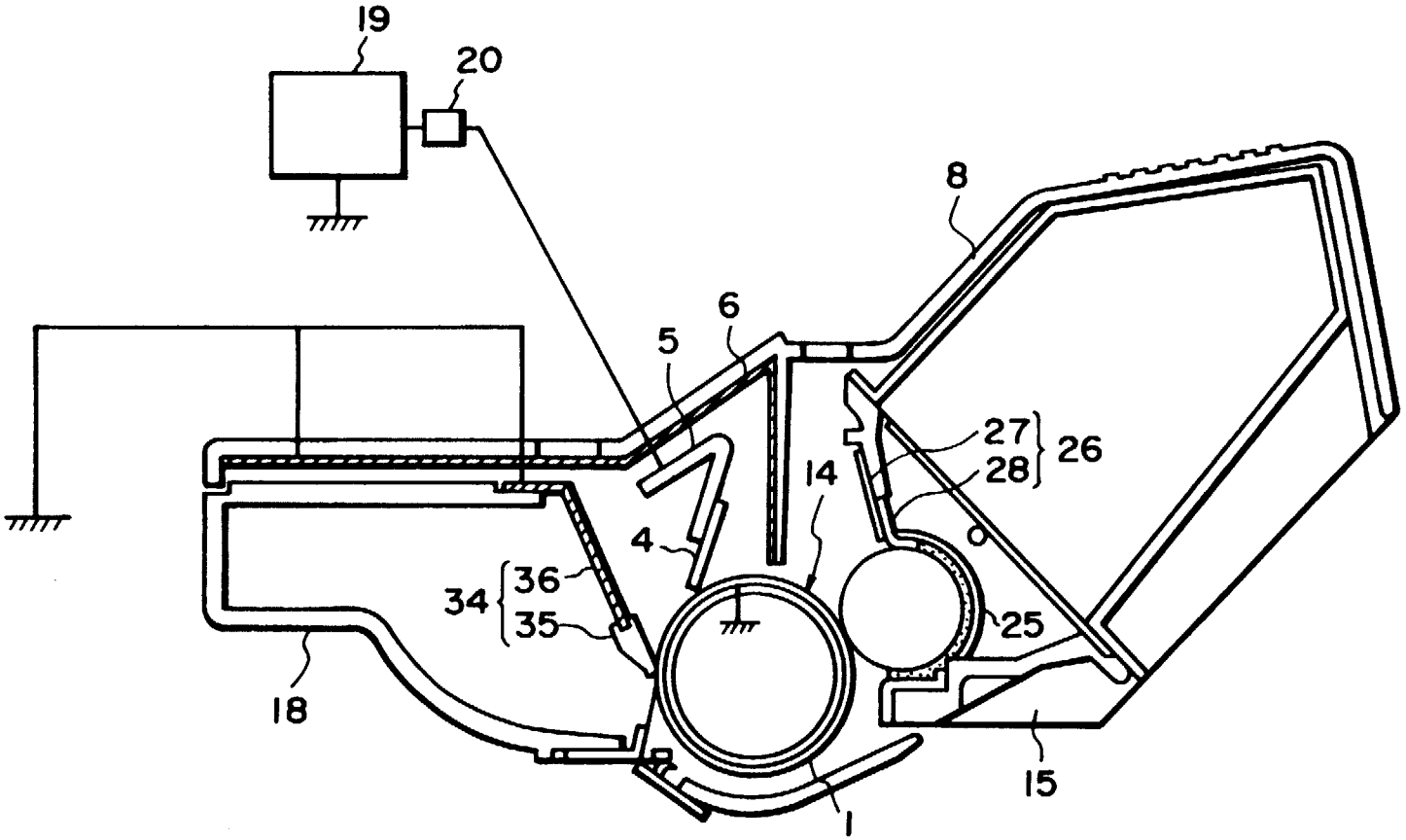
FIGS. 3 and 7 are side views of a process unit and an image forming apparatus according to a third embodiment of the present invention.

FIG. 3 shows a process unit, according to a further embodiment of the present invention, which is detachably mountable to the image forming apparatus. In this Figure, the same reference numerals as in FIG. 2 are assigned to the elements having corresponding functions. Only the charging member is different.

Figure 7:
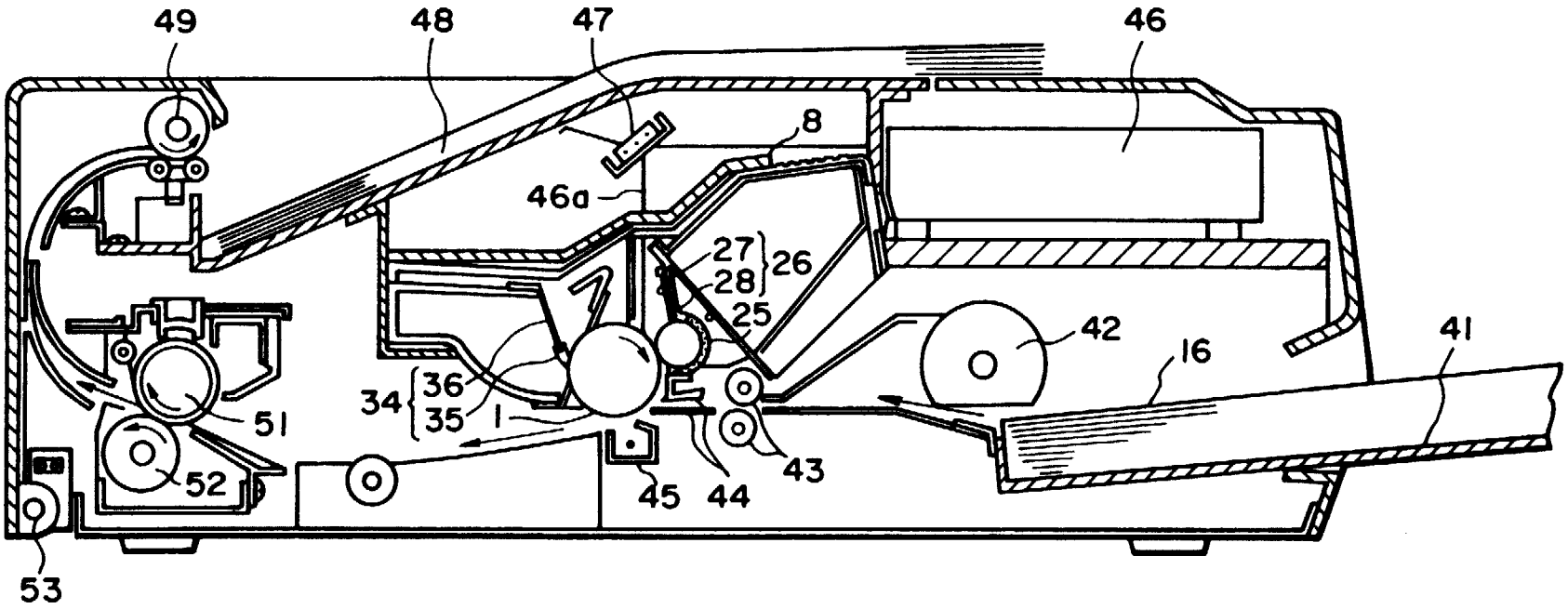

FIG. 7 shows an image forming apparatus incorporating the process unit of FIG. 3. Referring to FIGS. 3 and 7, the photosensitive member 1 rotates in the direction indicated by an arrow and is charged by a charging blade 4 which is contacted to the photosensitive member 1 and which is connected with a voltage source 10 through a constant current control means 20, provided in the main assembly of the apparatus. A laser beam 46*a* which is emitted from the laser scanner unit 46 and is modulated in accordance with an image signal is projected on the surface of the photosensitive member 1 by way of a mirror 47, so that an electrostatic latent image is formed on the photosensitive member 1. The electrostatic latent image thus formed on the photosensitive member 1 is developed by the developing device 15 with the toner powder carried on the developing sleeve 25. The toner powder is carried on the developing sleeve 25 in the form of a layer which, is regulated by the developing blade 26. Transfer sheets 16 accommodated in a cassette 41 are fed out one by one by a feeding roller 42 and are further fed by registration rollers 43 in timed relation with the emission of the laser beam, and are supplied to an image transfer position along a guide 44. At the transfer position, the toner image is transferred from the photosensitive member 1 onto the transfer material 16 by a transfer corona discharger 45. After receiving the toner image, the transfer material 16 is fed to an image fixing device comprising a fixing roller 51 and a back-up roller 52. The toner image is fixed and then discharged to the tray 48 by the discharging rollers 49. On the other hand, the photosensitive member 1 after being subjected to the image transfer operation, the residual toner is removed by the cleaning device 18.

As shown in FIG. 3, the photosensitive member 1, the developing device 15, the cleaning device 18, the charging, devices 4, 5 and 6 are supported on a frame, thus constituting a process unit. The process unit is detachably mountable to the main assembly of the image forming apparatus. The process unit 8 may comprise at least the photosensitive member and the charging device.

As shown in FIG. 7, the main assembly of the apparatus is of a bishelve type which is divisible along the transfer material carrying passage, that is, between the photosensitive member 1 and the transfer top frame is rotatable in a counterclockwise direction as shown in the Figure, about a pivot 53. When the apparatus is opened, the process unit 8 may be mounted into or dismounted from the top frame.

Figure 4:
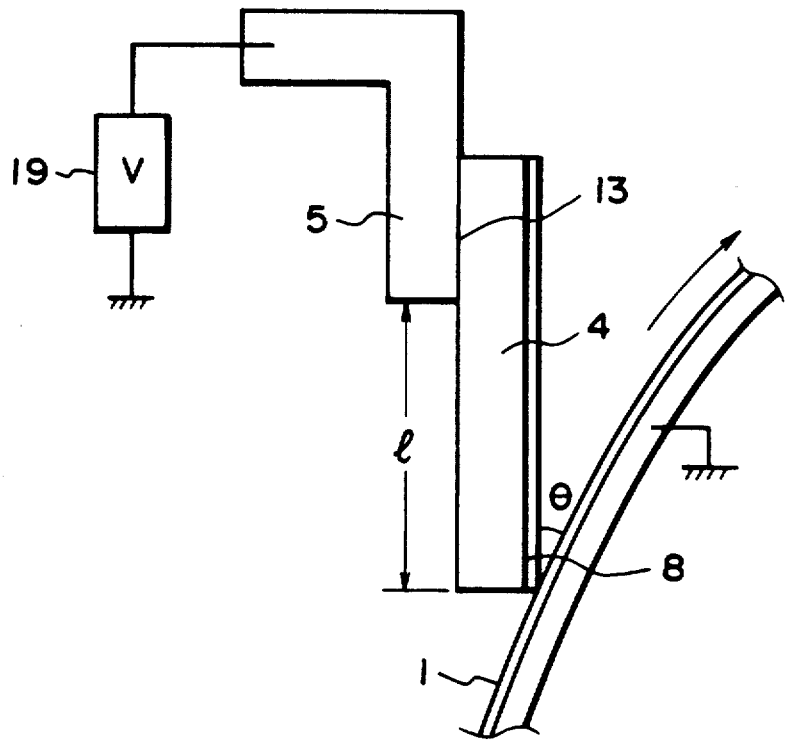
FIG. 4 is a side view illustrating a primary charger used in the third embodiment.
Figure 5:
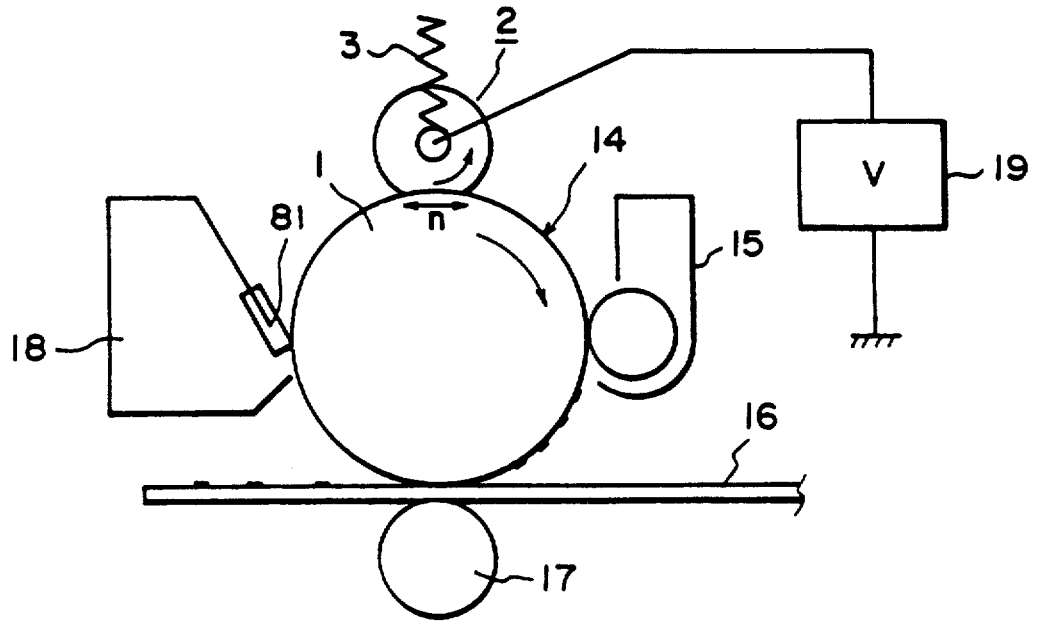
FIG. 5 PRIOR ART
FIG. 5 is a side view of a conventional contact type charging device.

Referring to FIG. 4, the charging device in the process unit 8 will be described. The charging blade 4 has a thickness of 1-2 mm and is a rubber blade of hydrin, EPDM, urethane or NBP material having a controlled resistance of $10^5$-$10^8$ ohm.cm, for example. The base side of the blade is mounted to a rigid conductive supporting member 5 made of steel or the like by an electrically conductive adhesive material 13. The free length of the blade is 5-20 mm (the distance between the end of the blade supporting member and the contact portion between the blade and the photosensitive drum). The contact angle is 8-25 degrees (the angle formed between the end portion of the blade and a downstream part of the drum tangential line at the contact point with respect to the movement direction of the drum surface). The contact pressure is 4-40 g/cm. The edge of the blade is counter-directionally contacted to the photosensitive drum 1 (the contact angle is acute). The contact between the charging blade 4 and the photosensitive drum 1 may be codirectional (the acute angle is dull).

Reference numeral 38 designates a surface resistance layer provided at the contact portion with the photosensitive drum 1, and it has a volume resistivity of $10^8$-$10^{12}$ ohm.cm. It is a thin layer (2 - 100 microns) and is made of nylon, urethane rubber or the like having a controlled resistance. It is printed on the charging blade 4.

As described in the foregoing, the voltage source 19 supplies a voltage to the charging blade. The voltage source 19 supplies the conductive rigid supporting member 5 of the charging blade 4 with a DC voltage which is determined in accordance with the potential of the photosensitive drum, for example. The voltage may be biased with an oscillating voltage having a peak-to-peak voltage which is not less than twice a charge starting voltage between the charging blade and the photosensitive drum (a voltage $V_{TH}$ at which the photosensitive member starts to be charged only when a DC voltage is applied), so as to provide better uniformity of the charging action. Thus, the charging blade 4 is supplied with the electric power through the supporting member 5, so that an electric field is produced between the photosensitive drum 1 and the charging blade 4 having the surface resistance layer 38, by which the surface of the photosensitive drum 1 is uniformly charged to a predetermined potential of a predetermined polarity.

As shown in FIG. 3, a copper foil 6 (conductive member) having a thickness of approximately 0.3 mm is bonded to the inside of the process unit by a two-sided tape so as to cover the charging blade 4. The copper foil is grounded. Although not shown, the supporting member 5 is fixed on the frame 7 by screws. The holder 36 for the cleaning blade 35 is made of conductive material and is also grounded with the copper foil 6. The copper foil 6 and the holder 36 the lengths larger than that of the blade 4 (measured in the longitudinal direction of the charging blade 4, that is, in the direction perpendicular to the sheet of the drawing of FIG. 3).

The electromagnetic field strength measured in this embodiment was less than 30 Db, too. In the contact charging system using the charging blade, similarly to the foregoing embodiments, the noise producing portion in the neighborhood of the nip of the contact charging is covered with the grounded conductive member, by which the problem of noise emission can be solved.

In the FIG. 3 embodiment, the conductive member is in the form of a copper foil bonded by a two-sided tape. In place of the copper foil, the inside wall of the process unit may be coated with copper material.

In the foregoing embodiments, the preferable volume resistivity for effectively reducing the noise emission is not more than $10^3$ ohm.cm.

The process unit 8 shown in FIG. 2 is detachably mountable to the image forming apparatus of FIG. 7.

When an alternating electric field is formed between the charging member and the photosensitive member 1 by the application of the oscillating voltage to the contact charging member in order to make the charging action uniform and stable, the noise emission is larger than when the charging member is supplied with a DC voltage. Therefore, the provision of the conductive member is particularly effective.

In the foregoing embodiments, the charging of the photosensitive member is not limited to the case of increasing the potential of the photosensitive member but includes the case of decreasing the potential thereof (discharging).

In the foregoing embodiments, the distance between the charging member and the conductive member covering the nip between the photosensitive member 1 and the charging member is preferably smaller, since then the required area of the conductive member is small. However, if it is to close, leakage occurs between the charging member and the conductive member, and therefore, the charging power to the photosensitive member 1 decreases with the result of possible improper image formation In view of this, the charging member and the conductive member are spaced with a distance sufficient to maintain the insulative state. When, for example, the charging member is supplied with a DC voltage of approximately 2.0 KV, the minimum required distance between the charging member and the conductive member was approximately 3 mm.

The grounding includes a signal grounding for the circuit, and a frame grounding (connection with the earth). In the embodiments, the conductive member is directly connected to the frame ground. When it is directly connected to the signal ground, it is effective to prevent noise emission. However, if it is connected to the frame ground through the signal ground in the circuitry the image forming apparatus, the noise produced by the charging device is introduced into the circuitry with the result of erroneous operation of the main assembly of the image forming apparatus. Therefore, it is preferably directly connected to the frame ground.

In the charging device of the contact type, the noise emission occurs more or less when charging member charges the photosensitive member 1 (primary charge). Therefore, the present invention is effective for the prevention of noise emission from a contact type charging device. The provision of a conductive member is particularly effective in such an embodiment in which the constant current control (560 micro-ampere, for example) is effected to maintain the uniformity of charging irrespective of the ambient conditions with the use of oscillating current to the charging member, since then the noise emission to the outside of the apparatus is relatively large.

When the current to the charging member is controlled to be constant, it is preferable that current between the charging member and the conductive member is prevented, since then a constant electric field is formed between the charging member and the photosensitive drum. As described in the foregoing, according to the present invention, the problem of electrostatic noise emission which is a problem when the advantageous contact type charging is used, can be significantly reduced.

While the invention has been described with reference to the structures disclosed herein, it is not confined to the details set forth and this application is intended to cover such modifications or changes as may come within the purposes of the improvements or the scope of the following claims.

What is claimed is:

1. A charging apparatus, comprising:

a charging member contactable to a member to be charged to charge the member to be charged;

power supplying means for supplying a voltage between said charging member and the member to be charged; and a conductive member for covering a contact portion between said charging member and the member to be charged, wherein said conductive member covers a side of said charging member opposite said member to be charged, and is electrically grounded.

2. An apparatus according to claim 1, wherein said conductive member extends in a direction of a length of said charging member.

3. An apparatus according to claim 2, wherein said conductive member is longer than said charging member.

4. An apparatus according to claim 1, wherein no electric current flows between said charging member and said conductive member.

5. An apparatus according to claim 1 or 4, further comprising control means for maintaining a constant current flow through said charging member.

6. An apparatus according to claim 1, wherein the voltage comprises an oscillating component.

7. An apparatus according to claim 6, further comprising control means for providing a constant current of the oscillating component.

8. An apparatus according to claim 1, wherein said charging member is in the form of a rotatable member.

9. An apparatus according to claim 1, wherein said charging member is in the form of a blade.

10. A process unit detachably mountable to an image forming apparatus, comprising:

an image bearing member;

a charging member contactable to said image bearing member to charge said image bearing member, for applying a voltage supplied by an external power source between said charging member and said image bearing member; and a conductive member covering a contact portion between said image bearing member and said charging member, wherein said conductive member covers a side of said charging member opposite said image bearing member, and is grounded.

11. An image forming apparatus, comprising:

an image bearing member;

image forming means for forming an image on said image bearing member;

a charging member contactable to said image bearing member to charge said image bearing member;

power supplying means for supplying a voltage between said image bearing member and said charging member; and a conductive member covering a contact portion between said image bearing member and said charging member, wherein said conductive member covers a side of said charging member opposite said image bearing member, and is electrically grounded.

12. An apparatus according to claim 11, further comprising a cleaning member for cleaning said image bearing member, wherein said cleaning member is supported by said conductive member.

13. An apparatus according to claim 11 or 12, further comprising a developer carrying member for carrying a developer for developing an image on said image bearing member, a regulating member for regulating a layer of the developer on said image bearing member, wherein said regulating member is supported by said conductive member.

14. An apparatus according to claim 12, wherein said conductive member is extended along a length of said charging member, and said conductive member has a length larger than a length of said charging member.

15. An apparatus according to claim 11, wherein no electric current flows between said charging member and said conductive member.

16. An apparatus according to claim 11 or 15, further comprising control means for controlling so that a constant current flows through said charging member.

17. An apparatus according to claim 11, wherein the voltage comprises an oscillating component.

18. An apparatus according to claim 17, further comprising control means for providing a constant current of the oscillating component.

19. An apparatus according to claim 11, wherein said charging member is in the form of a rotatable member.

20. An apparatus according to claim 11, wherein said charging member is in the form of a blade.

21. An apparatus according to claim 11, wherein said conductive member substantially covers said charging member.

22. An apparatus according to claim 11, further comprising an electrically conductive supporting member for supporting said image bearing member, said supporting member being electrically grounded.

23. An apparatus according to claim 21, further comprising an electrically conductive supporting member for supporting said image bearing member, said supporting member being electrically grounded.

* * * * *

UNITED STATES PATENT AND TRADEMARK OFFICE

CERTIFICATE OF CORRECTION

PATENT NO. : 5,272,505

DATED : December 21, 1993

INVENTOR(S) : KAZUO SHISHIDO, ET AL.

It is certified that error appears in the above-indentified patent and that said Letters Patent is hereby corrected as shown below:

On the title page, item [56]:

In the References Cited [U.S. Patent Documents]

Insert, --4,851,960 7/1989 Nakamura et al....361/225
4,708,455 11/1987 Kubota et al....355/3R--.

COLUMN 1:

line 17, "and member," should read --member, and--;
line 63, "Db should read --dB--.

COLUMN 3:

line 52, "like, a" should read --like, and a-- and
line 63, "i made" should read --is made--.

COLUMN 4:

line 5, "30 Db." should read --30 dB.--;
line 61, "30 Db," should read --30 dB,--; and
line 62, "45 Db," should read --45 dB--.

COLUMN 5:

line 55, "the residual toner is removed" should read --is cleaned of residual toner--;
line 58, "ing," should read --ing--;
line 64, "bishelve" should read --bishelf--;
line 66, "transfer top" should read --transfer charger 45, into a top frame and a bottom frame. The top--; and
line 67, "direction as" should read --direction, as --.

UNITED STATES PATENT AND TRADEMARK OFFICE

CERTIFICATE OF CORRECTION

PATENT NO. : 5,272,505 Page 2 of 2

DATED : December 21, 1993

INVENTOR(S) : KAZUO SHISHIDO ET AL.

It is certified that error appears in the above-indentified patent and that said Letters Patent is hereby corrected as shown below:

COLUMN 6:

line 59, "the lengths" should read --have lengths--; and
line 64, "30 Db, too" should read -- 30 dB, also.--.

COLUMN 7:

line 30, "to" should read --too--;
line 34, "formation" should read --formation.--;
line 48, "the image" should read --of the image--;
line 53, "the noise" should read --noise--; and
line 54, "charging" should read --the charging--.

Signed and Sealed this

Ninth Day of August, 1994

Bruce Lehman

*Attest:*

BRUCE LEHMAN

*Attesting Officer*

*Commissioner of Patents and Trademarks*